US005341656A

United States Patent [19]

Rust, Jr. et al.

[11] Patent Number: 5,341,656

[45] Date of Patent: Aug. 30, 1994

[54] COMBINATION EXPANSION AND FLOW DISTRIBUTOR DEVICE

[75] Inventors: Raymond A. Rust, Jr.; Larry D. Amick, Brownsburg, both of Ind.

[73] Assignee: Carrier Corporation, Syracuse, N.Y.

[21] Appl. No.: 65,239

[22] Filed: May 20, 1993

[51] Int. Cl.[5] ..... F25B 13/00

[52] U.S. Cl. ..... 62/324.6; 62/504; 62/525

[58] Field of Search ..... 62/324.6, 525, 511, 62/504

[56] References Cited

U.S. PATENT DOCUMENTS 3,110,162 11/1963 Gerteis ..... 62/324.6
3,320,076 3/1965 Harnish .
3,745,787 7/1973 Ponziani .
3,864,938 2/1975 Hayes, Jr. ..... 62/525
3,992,898 11/1976 Duel ..... 62/324.6
4,182,412 1/1980 Shum .
4,324,112 4/1982 Fujiwara et al. .
4,430,868 2/1984 Kern et al. .
4,643,222 2/1987 Wiser .
4,840,038 6/1989 Sato .
4,951,478 8/1990 McDonald .
5,085,058 2/1992 Aaron et al. .

*Primary Examiner*—John M. Sollecito

[57] ABSTRACT

A combination expansion and flow distributor unit suitable for use in a heat pump for homogeneously mixing liquid and vapor phase refrigerant throttled through the expander section and uniformly distributing the mixture into the individual flow circuits of a downstream heat exchanger.

10 Claims, 2 Drawing Sheets

COMBINATION EXPANSION AND FLOW DISTRIBUTOR DEVICE

BACKGROUND OF THE INVENTION

This invention relates to an improved combination expansion device and flow distributor unit for use in a reverse cycle (heat pump) air conditioning system.

A combination expansion device and flow distributor unit is disclosed in U.S. Pat. No. 4,643,222 which issued in the name of Wiser. A free floating piston is mounted within a housing which is arranged to close against the entrance of a passageway when refrigerant moves in one direction between a pair of multiple circuit heat exchangers. The piston contains a metering orifice through which refrigerant is throttled when the piston is in a closed position. The throttled refrigerant, which is in both the vapor phase and liquid phase, is discharged into an axially-aligned, drilled hole. A series of distributor channels are each passed at an acute angle into the distal end of the drilled hole. The axial length of the hole is extremely short and, as a consequence, the refrigerant vapor phase will not mix homogeneously with the vapor phase before the mixture enters the distributor channels. By the same token, because of the shallow entrance angle to the distributor channels, unequal amounts of refrigerant mixture can be discharged into each channel unless the flow directing surfaces are precisely machined. Accordingly, the performance of the individual downstream heat exchanger circuits will be adversely effected.

High precision distributors are available which are capable of more evenly distributing refrigerent into a multiple circuit heat exchanger. These devices, however, are relatively complex and expensive. Despite the use of precision parts, the distribution of refrigerant is oftentimes non-homogeneous and uneven. For the most part, these precision distributors are not applicable for use in reverse cycle systems.

SUMMARY OF THE INVENTION

It is therefor an object of the present invention to improve heat pump systems.

It is a further object of the present invention to provide an improved combination expansion device and refrigerant distributor unit that is capable of uniformly distributing a homogeneous mixture of vapor phase and liquid phase refrigerant to the circuits of a multiple circuit heat exchanger.

A still further object of the present invention is to provide an expansion device and flow distributor unit for use in a heat pump that can deliver high efficiency performance regardless of the units mounted position.

Another object of the present invention is to provide a combination piston-equipped, expansion device suitable for use in a heat pump that is equipped with a high performance flow distributor that does not require expensive precision machining or working of parts.

Yet another object of the present invention is to improve the distribution of liquid phase and vapor phase refrigerant into a multiple circuit evaporator.

These and other objects of the present invention are attained by a combination of expansion device and flow distributor unit suitable for use in a heat pump utilizing multiple circuit heat exchangers. The unit includes an elongated housing having a floating piston mounted within a piston chamber. One end of the chamber is connected to a liquid refrigerant line so that the piston is forced back against a sealing seat when refrigerant enters the chamber through the liquid line. The piston has a metering orifice therein through which entering refrigerant is throttled into a control chamber. A mixture of vapor phase and liquid phase refrigerant is discharged into a flow control channel. The control channel geometry is configured so that the vapor phase and liquid phase are homogeneously mixed within the channel. The channel passes the mixture radially into an annular passage that connects the channel with a series of axially-disposed flow tubes. Each tube, in turn, is connected to a separate flow circuit in the downstream evaporator. Accordingly, the refrigerant is forced to undergo two ninety degree turns before it is forwarded to the individual circuits thus insuring a thorough homogeneous mixing of the vapor and liquid refrigerant phases and the correct distribution of the mixture.

BRIEF DESCRIPTION OF THE DRAWINGS

For a better understanding of these and other objects of the present invention, reference shall be made to the following detailed description of the invention which is to be read in conjunction with the associated drawings, wherein.

DESCRIPTION OF THE INVENTION

Figure 1:
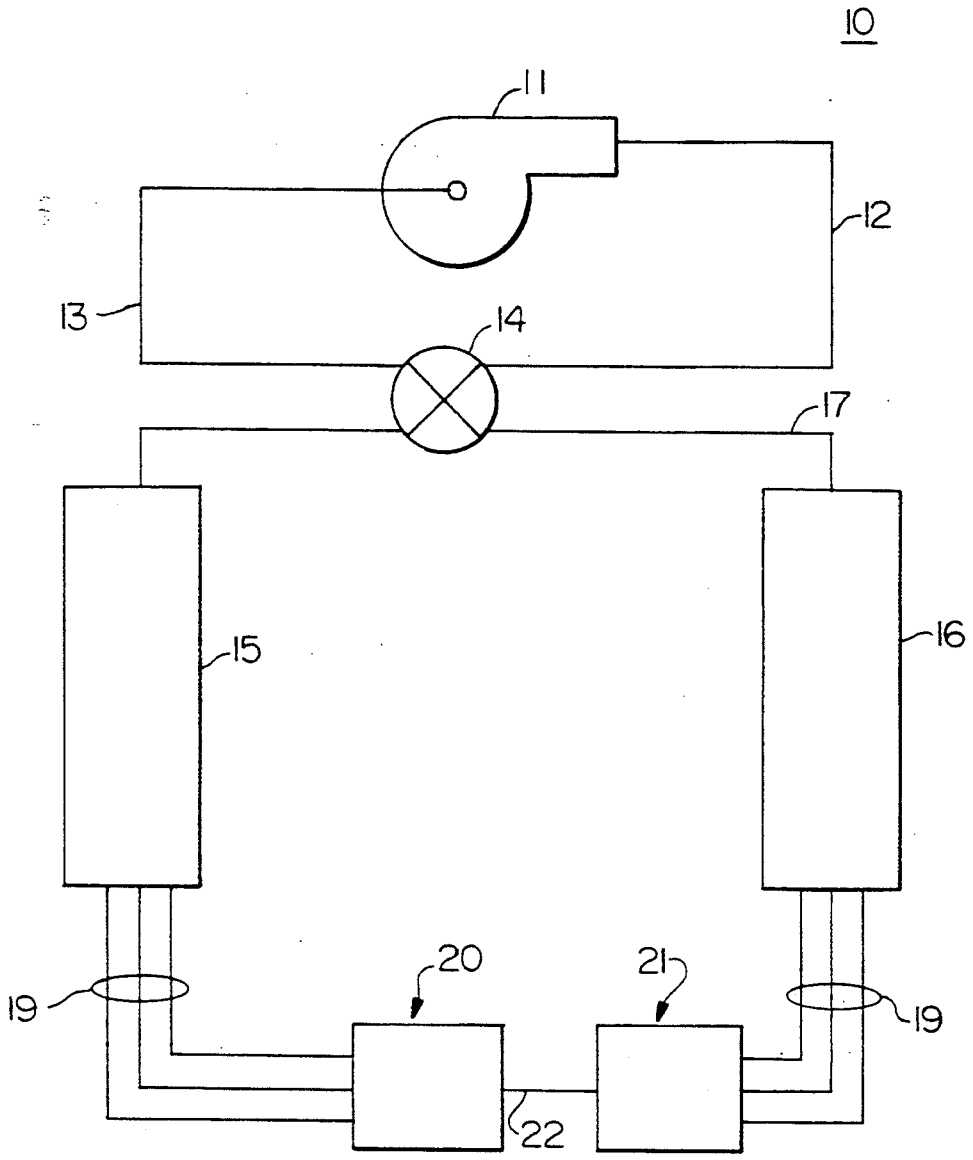
FIG. 1 is a schematic representation of a reverse cycle air conditioning system that utilizes the combination expansion device and flow distributor unit of the present invention.

Referring initially to FIG. 1, there is illustrated schematically a heat pump system, generally referenced 10, that includes a compressor 11 having a discharge line 12 and a suction line 13 connected to a four-way flow reversing valve 14. The system further includes a pair of heat exchangers 15 and 16 capable of operating in either a condensing or evaporating mode. One side of each heat exchanger is connected to the flow reversing valve by means of lines 17—17. The opposite sides of the heat exchangers are interconnected by a liquid line 22. A pair of combination expansion and flow distributor units 20 and 21 are mounted in the liquid line. As will be explained in greater detail, the function of the units are automatically reversed, depending upon the direction of the refrigerant flow through the system, to separate the high pressure side of the system from the low pressure side. In the event heat exchanger 15 is operating in an evaporating mode, unit 21 will be conditioned to freely pass liquid refrigerant from the condensing heat exchanger 16 to the second unit 20. At this time, unit 20 is conditioned to throttle the refrigerant from the high pressure side of the system to the low pressure side whereby vapor phase and liquid phase refrigerant are delivered to the heat exchanger 15.

Each of the heat exchangers contains multiple flow circuits which are penalized by a poor distribution of refrigerant, thus considerably reducing the efficiency of the heat pump. The units 20 and 21 are specifically designed to uniformly distribute even amounts of homogeneously mixed, throttled refrigerant into each of the downstream flow circuits without regard to the system's physical positioning.

Units 20 and 21 are both of similar construction and function in the same manner to throttle and distribute refrigerant into an associated heat exchanger when the heat exchanger is operating in an evaporating mode. Accordingly, the liquid line side of each unit will herein be referred to as the proximal side of each unit, while the opposite or heat exchanger side of each unit will be referred to as the distal side. Because of the similarity of the units, only one of the units, unit 20, will be explained in greater detail below.

Figure 2:
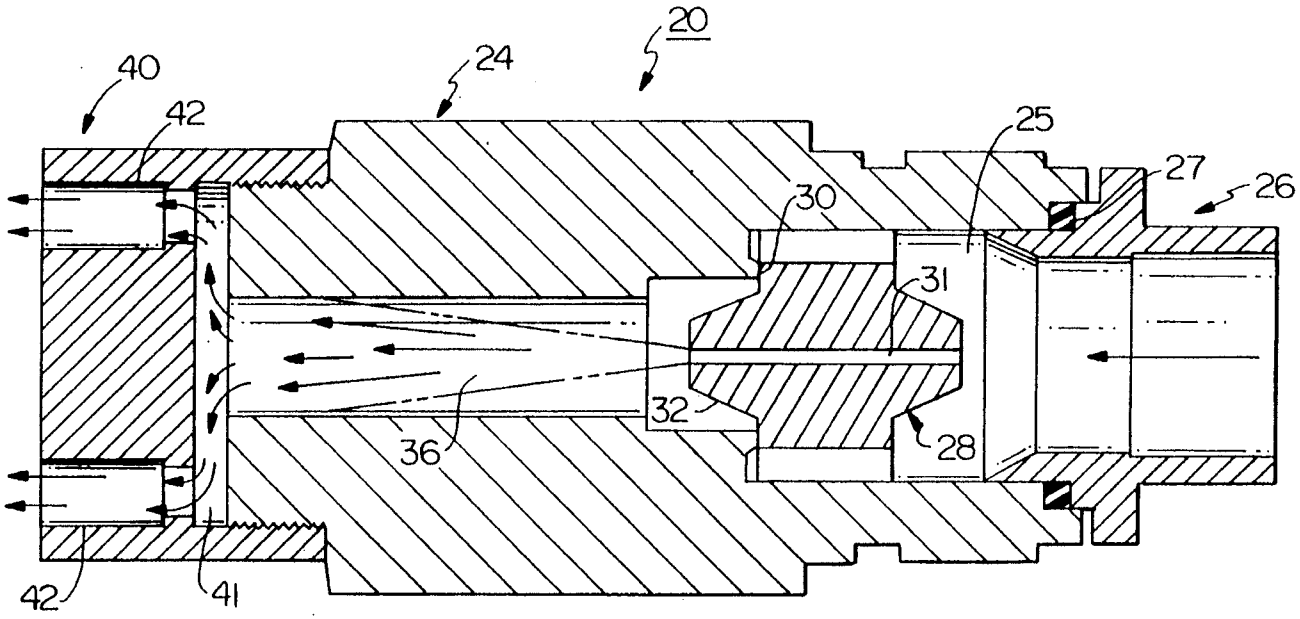
FIG. 2 is an enlarged side elevation in section illustrating the combination expansion device and flow distributor of the present invention.
Figure 3:
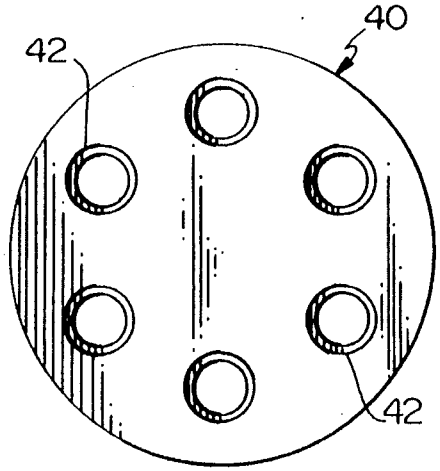
FIG. 3 is an end view of the device illustrated in FIG. 1.

With further reference to FIGS. 2 and 3, unit 20 includes an elongated housing 24 having an axially-disposed piston chamber 25 formed therein that opens outwardly through the proximal end of the housing. A connector 26 is joined by suitable means to the open end of the piston chamber to provide a leak tight joint between the liquid line 22 and the piston chamber. An O-ring 27 is compressed between the housing and the connector to complete the connection.

A free floating piston 28 is slidably contained within the piston chamber and is arranged to move from one side of the chamber to the other under the influence of the refrigerant flow. When the refrigerant is moving in the direction indicated by the arrows, the body of the piston will be arrested against a seat 30 as shown in FIG. 2 and the heat exchanger will be operating in an evaporating mode. The seat is a raised ring having a flat sealing surface that contacts the flat end face of the piston. The end face is protected behind the nose cone 32 of the piston which prevents the piston from cocking and improves sealing. Reversal of the flow will force the piston away from the seat toward the proximal or liquid line side of the chamber.

Piston 28 contains a series of peripheral grooves 34 which allow refrigerant to flow freely about its body when the piston is driven toward the proximal side of the chamber. A metering orifice 31 passes axially through the body of the piston and serves to throttle refrigerant from the high pressure side of the system into the low pressure side when the piston is closed against the seat as shown in FIG. 2. As should be evident from the disclosure above, one of the units will always be acting as an expansion device while the other device is in an open position, depending on the direction of flow through the system.

A flow control channel 36 is located in the distal end of the housing and is arranged to receive the liquid phase and vapor phase refrigerant throttle through the metering orifice. The control channel provides a carefully sized zone having a length in the general direction of refrigerant flow through said expansion device and a width substantially smaller than said length, said channel length and width thereby allows the expanding refrigerant to slow down and completely fill the channel so that sufficient energy remains in the refrigerant to prevent separation of the liquid phase and vapor phase and to overcome gravitational effects produced by the system's orientation.

The control channel opens into a distributor section 40 that is threaded onto the distal end of the housing. The distributor functions to uniformly distribute the homogeneous mixture of refrigerant into the individual flow circuits 19—19 (FIG. 1) of the downstream heat exchanger. The distributor includes an annular-shaped distribution passage 41 that is arranged to receive the refrigerant mixture form the flow control channel and turn the flow ninety degrees. A series of flow tubes equal in number to the number of circuits in the downstream heat exchanger are passed axially through the distal end face 43 of the distributor section into the distribution passage.

A still energetic homogeneous flow with no voids fills the distributor passage and spreads evenly into the flow tubes without regard to their specific location.

It should be noted that the flow tubes are not visible to the energetic flow moving through the control channel and that the flow must make two ninety degree turns before it enters the downstream heat exchanger circuits. Here again, the distance and sizing of the flow paths are controlled so that sufficient energy remains in the distributed flow to maintain a homogeneous mixture and insure even distribution of the flow. It should be further noted that this highly desirous result is attained using simple machined parts not requiring precision cone points or angular drilling as in the case of similar prior art devices.

Although the invention has been described with specific reference to a, heat pump application, it has equal application in any type of system where homogeneous and equal distribution of a refrigerant mixture is required or desirable. While this invention has been explained with reference to the structure disclosed herein, it is not confined to the details set forth and this invention is intended to cover any modifications and changes as may come within the scope of the following claims:

What is claimed is:

1. A combination expansion and flow distributor device that accommodates bidirectional flow and is suitable for use in a reverse cycle air conditioning system said device including:

an elongated housing having a distal end and a proximal end which contains a chamber that opens through the proximal end of the housing whereby the chamber can be connected to the liquid line of a reverse cycle air conditioning system, a flow distribution section situated at the distal end of said housing having a radially-expanded distribution passage and a series of axially-disposed flow tubes in fluid flow communication with said passage which discharges through the distal end of said housing, whereby said flow tubes can each be connected to separate flow circuits of a heat exchanger, an elongated control channel connecting the distal end of said chamber and said flow distribution passage which is radially offset from said flow, said control channel having a length in the general direction of refrigerant flow through said elongated housing and a width substantially smaller than said length, said channel length and width thereby defining means to allow expanding refrigerant to slow down and completely fill said channel so that sufficient energy remains in the refrigerant to prevent separation of said refrigerants liquid's refrigerant and vapor phases and so to overcome gravitation effects of the system's orientation, a free floating piston slidably mounted within said chamber, said piston having an axially-disposed metering orifice passing therethrough, and seating means located at the distal end of said chamber at the entrance to said control channel for sealing the piston against said entrance, whereby refrigerant moving from said liquid line toward said heat exchanger is throttled through said metering orifice into said control chamber.

2. The device of claim 1 wherein the piston contains peripheral grooves for freely passing refrigerant about the piston when the piston is unseated from said seating means.

3. The device of claim 1 wherein said control channel has a geometry such that liquid phase and vapor phase refrigerant throttled through said metering orifice is homogeneously mixed prior to entering the distribution passage.

4. The device of claim 1 wherein said distribution passage is annular in form and the flow tubes are equally spaced about the passage so that the flow of refrigerant throttled onto the control channel must make two ninety degree turns prior to leaving said flow tubes.

5. The device of claim 1 wherein said flow distribution section is threadably secured to said housing.

6. The device of claim 1 that further includes a connector means for coupling a liquid line to said housing.

7. The device of claim 2 wherein said seating means is a raised ring at the entrance to the control channel that seals against the body of the piston between the metering orifice and said peripheral grooves.

8. In a reverse cycle air conditioning system having first and second heat exchangers, each of which contains multiple flow circuits, a compressor means and a reversing valve connecting the compressor means to one side of said heat exchangers so that the flow of refrigerant therethrough is reversible and a liquid line connecting the other side of said heat exchangers, the improvement comprising at least one expansion and flow distributor device, that accommodates bidirectional flow, mounted in the liquid line, and includes an elongated housing having a distal end and a proximal end and further containing a piston chamber that opens through the proximal end and coupling means for connecting the proximal end of the chamber to said liquid line, a flow distribution section situated at the distal end of the housing having a radially-expanded annular distribution passage and a series of equally spaced flow tubes in fluid flow communication with said passage, each flow tube being connected to a flow circuit in one of said heat exchangers, an elongated control channel connecting the distal end of said piston chamber and said passage, said control channel having a length in the general direction of refrigerant flow through said elongated housing and a width substantially smaller than said length, said channel length and width thereby defining means to allow expanding refrigerant to slow down and completely fill said channel so that sufficient energy remains in the refrigerant to prevent separation of said refrigerants liquid's refrigerant and vapor phases and so to overcome gravitation effects of the system's orientation, a free floating piston having a body slidably mounted in the piston chamber, said body having an axially-disposed metering orifice passing centrally therethrough and grooves axially extended about the periphery, seating means located at the distal end of said piston chamber at the entrance to said control channel for sealing the body of the piston against said entrance when refrigerant is moving from the liquid line toward said one heat exchanger whereby refrigerant is throttled through said metering orifice into said control channel and to release the body of the piston when refrigerant is moving in the opposite direction.

9. The improvement of claim 8 wherein said control channel has a geometry such that liquid and vapor phase refrigerant throttled through said metering orifice is homogeneously mixed in said channel.

10. The improvement of claim 9 that further includes a second expansion and flow distributor device mounted in the liquid line and said second heat exchanger having its piston chamber connected to the liquid line in opposition to the piston chamber of said at least one expansion and flow distributor device and its flow tubes connected to flow channels in said second heat exchanger.

* * * * *